US006206019B1

(12) United States Patent
Horvitz

(10) Patent No.: US 6,206,019 B1
(45) Date of Patent: Mar. 27, 2001

(54) CONVERTIBLE CANE CONSTRUCTION

(76) Inventor: Michele Horvitz, 1115 Hedgerow La., Philadelphia, PA (US) 19115

( * ) Notice: Subject to any disclaimer, the term of this patent is extended or adjusted under 35 U.S.C. 154(b) by 0 days.

(21) Appl. No.: 09/435,421

(22) Filed: Nov. 8, 1999

(51) Int. Cl.[7] ..... A61H 3/02

(52) U.S. Cl. ..... 135/74; 135/67; 135/75; 135/66

(58) Field of Search ..... 135/74, 75, 67, 135/66; 248/155

(56) References Cited

U.S. PATENT DOCUMENTS

| | | | | |
|---|---|---|---|---|
| 3,716,067 | * | 2/1973 | Skoog . | |
| 4,121,605 | | 10/1978 | Schmerl . | |
| 4,251,044 | * | 2/1981 | Olson | 248/166 |
| 4,411,283 | | 10/1983 | Lucarelli . | |
| 4,729,395 | * | 3/1988 | Adamson et al. | 135/67 |
| 4,787,405 | | 11/1988 | Karwoski . | |
| 4,995,412 | * | 2/1991 | Hirn et al. | 135/67 |
| 5,339,849 | | 8/1994 | Stutz . | |
| 5,482,070 | | 1/1996 | Kelly . | |
| 5,499,645 | * | 3/1996 | Baliga | 135/67 |
| 5,644,994 | * | 7/1997 | Liang et al. | 108/116 |
| 5,979,476 | * | 11/1999 | Cranny | 135/67 |

FOREIGN PATENT DOCUMENTS

| | | | | |
|---|---|---|---|---|
| 1831308 | * | 7/1993 | (SU) | 135/66 |

* cited by examiner

*Primary Examiner*—Robert Canfield
(74) *Attorney, Agent, or Firm*—Henderson & Sturm LLP

(57) ABSTRACT

A convertible cane construction 10 including a pair of cane members 20, 20 connected to one another by a pair of collapsible arm members 30, 30'. Each collapsible arm member 30, 30' is movable between a fully extended mode which widely separates the cane members 20 and a fully collapsed mode which joins the pair of cane members 20, 20 into a quasi-single cane configuration. Each collapsible arm member 30, 30' includes a pair of lever arms 31, 32 pivotally connected to one another on one end and pivotally connected to one of the cane members 20, 20 on the other end.

5 Claims, 1 Drawing Sheet

CONVERTIBLE CANE CONSTRUCTION

BACKGROUND OF THE INVENTION

1. Field of the Invention

The present invention relates to the field of walking cane constructions in general, and in particular to a cane construction that can be converted into a dual handled walker style device.

2. Description of Related Art

As can be seen by reference to the following U.S. Pat. Nos. 4,121,605; 4,411,283; 4,787,405; 5,339,849; and 5,482,070, the prior art is replete with myriad and diverse single and double cane constructions.

While all of the aforementioned prior art constructions are more than adequate for the basic purpose and function for which they have been specifically designed, they are uniformly deficient with respect to their failure to provide a simple, efficient, and practical arrangement wherein an apparent single cane can be converted into a spaced double cane arrangement that will provide improved traction on slippery surfaces or when the user is prone to attacks of vertigo.

As most users of single walking canes are aware, the single cane is well suited to the user's needs the vast majority of time; however, there are certain instances when enhanced stability is required and that extra stability is simply not possible with the single footprint provided by virtually all known walking canes.

As a consequence of the foregoing situation, there has existed a longstanding need for a new and improved type of convertible cane construction which can provide either an essentially single footprint support or a pair of widely spaced footprint supports when greater traction and stability are required, and the provision of such a construction is a stated objective of the present invention.

BRIEF SUMMARY OF THE INVENTION

Briefly stated, the convertible cane construction that forms the basis of the present invention comprises in general, a pair of walking cane members that are connected to one another by a pair of collapsible arm members which can be manipulated to bring the handle members either into a side by side quasi-single walking cane configuration, or into a widely spaced double walking cane configuration.

As will be explained in greater detail further on in the specification, each of the walking cane members have a generally inverted L-shaped configuration which includes a main support shaft and a rearwardly extending handle segment. The support shafts of the cane members are connected to one another by the pair of collapsible arm members.

In addition, each of the collapsible arm members comprise a pair of lever arms that are pivotally secured on one end to one another and pivotally secured on the other end to one of the walking cane members. In the collapsed mode, the lever arms bring the cane support shafts together and in the extended mode, the lever arms force the cane support shafts a substantial distance apart.

Furthermore, both of the walking cane members are vertically adjustable such that the opposed handles and lever arms can be disposed in horizontal planes when the can construction is employed on an angled side hill surface.

BRIEF DESCRIPTION OF THE SEVERAL VIEWS OF THE DRAWINGS

These and other attributes of the invention will become more clear upon a thorough study of the following description of the best mode for carrying out the invention, particularly when reviewed in conjunction with the drawings, wherein.

DETAILED DESCRIPTION OF THE INVENTION

Figure 1:
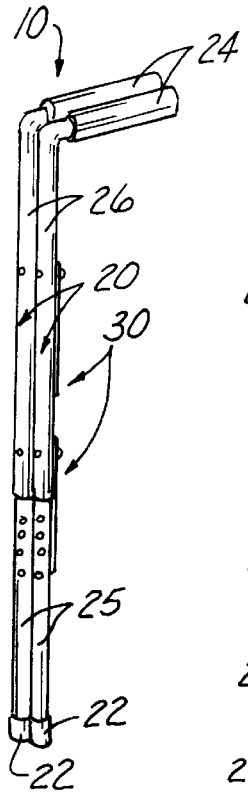
FIG. 1 is a perspective view of the convertible cane construction in the single walking cane configuration.

As can be seen by reference to the drawings, and in particular to FIG. 1, the convertible cane construction that forms the basis of the present invention is designated generally by the reference number 10. The construction 10 comprises in general a pair of cane members 20 connected together by a pair of collapsible arm members 30. These structural components will now be described in seriatim fashion.

Figure 2:
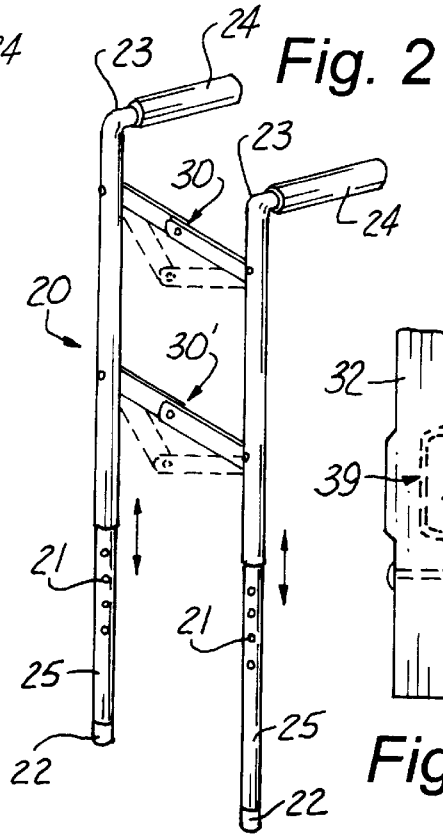
FIG. 2 is a perspective view of the cane construction in the spaced double walking cane configuration.

As can best be seen by reference to FIGS. 1 and 2, each of the cane members 20 have a generally inverted L-shaped configuration which includes an elongated adjustable height support shaft 21 whose lower end 25 is provided with a conventional rubberized foot pad 22 and whose upper end 26 is provided with a rearwardly extending handle element 23 likewise provided with a conventional handle grip 24.

Figure 3:
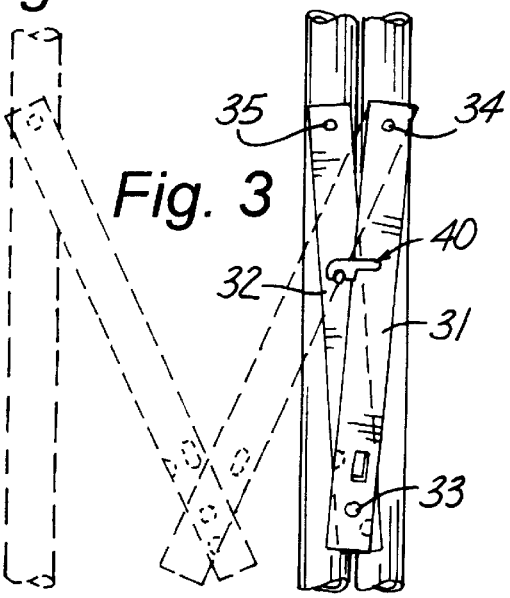
FIG. 3 is an illustration of the collapsing movement of one of the collapsible arm members.
Figure 4:
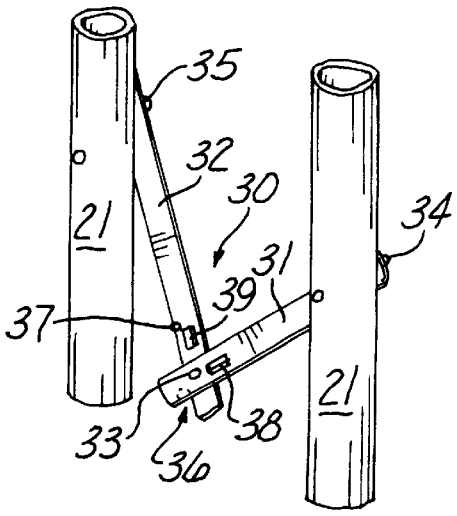
FIG. 4 is a front view showing one of the collapsible arm members partially collapsed.

Turning now to FIGS. 2 through 4, it can be seen that the pair of collapsible arm members 30 each comprise a pair of generally flat lever arms 31, 32 having inboard ends that are pivotally connected to one another as at 33 and having outboard ends which are pivotally connected as at 34 and 35 to one of the support shafts 21 of one of the cane members 21. One of the pair of collapsible arm members 30 is disposed on the upper portion of the cane members 20, 20 and the other pair of collapsible arm members 30' are disposed on the intermediate portion of the cane members 20, 20.

As shown in FIGS. 3 through 6, in each one of the collapsible arm members 30, one lever arm 31 is provided with a discrete recess 36 and the other lever arm 32 is provided with a discrete detent 37 that is dimensioned to engage the recess 36 when the lever arms 31, 32 are disposed in their fully extended position.

Furthermore, as shown in FIG. 3 in one version of the invention, the lever arms 31, 32 may also be provided with a latch and catch arrangement designated generally as 40 for maintaining the lever arms in their fully collapsed mode.

Figure 6:
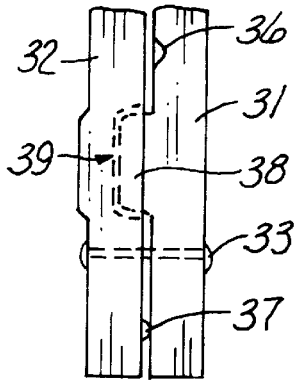
FIG. 6 is an isolated detail side view showing the lower end of one of the arm members fully collapsed.
Figure 5:
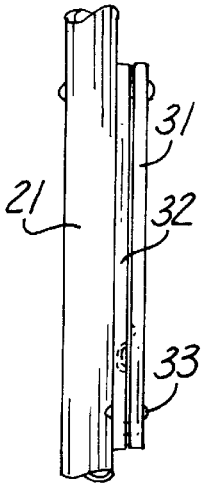
FIG. 5 is a side view showing one of the arm members fully collapsed.

In addition, as can best be seen by reference to FIG. 6, one of the lever arms 31 is provided with an enlarged projection 38 which will be frictionally engaged by an enlarged recess 39 formed on the other lever arm 32 when the lever arms 31 and 32 are disposed in their fully collapsed position.

Figure 7:
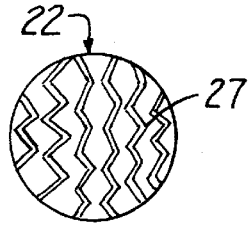
FIG. 7 is an end view of the tread pattern on the bottom of one of the cane members.

Turning now to FIG. 7, it can be seen that each of the foot pads 22 are provided with a traction tread designated generally as 27 to enhance the frictional engagement of the cane members 20, 20 both individually and in combination with one another.

During dry weather and on flat terrain, the user would employ the cane construction 10 in the quasi-single cane collapsed mode of FIG. 1 and in inclement weather and/or uneven terrain, the user would employ the cane construction 10 in the extended mode of FIG. 2.

Although only an exemplary embodiment of the invention has been described in detail above, those skilled in the art will readily appreciate that many modifications are possible without materially departing from the novel teachings and advantages of this invention. Accordingly, all such modifications are intended to be included within the scope of this invention as defined in the following claims.

Having thereby described the subject matter of the present invention, it should be apparent that many substitutions, modifications, and variations of the invention are possible in light of the above teachings. It is therefore to be understood that the invention as taught and described herein is only to be limited to the extent of the breadth and scope of the appended claims.

I claim:

1. A convertible cane construction comprising:

a pair of cane members wherein each cane member has a generally inverted L-shaped configuration which includes an elongated shaft member having an upper end provided with a handle element and a lower end provided with a foot pad; and, a pair of collapsible arm members wherein each collapsible arm member has one end connected to one of the pair of cane members and the other end connected to the other of the pair of cane members wherein one collapsible arm member is connected to the upper portion of the pair of cane members and the other collapsible arm member is connected to the intermediate portion of the cane members wherein each collapsible arm member is movable from a fully collapsed mode to a fully extended mode and wherein each of the collapsible arm members comprise:

a pair of lever arms pivotally connected on one end to one another and pivotally connected on the other end to one of the pairs of cane members.

2. The construction as in claim 1 wherein each of the collapsible arm members are provided with means for maintaining each arm member in the fully collapsed mode.

3. The construction as in claim 2 wherein each of the collapsible arm members are provided with means for maintaining each arm member in the fully extended mode.

4. The construction as in claim 1 wherein each of the collapsible arm members are provided with means for maintaining each arm member in the fully extended mode.

5. The construction as in claim 1 wherein each of the cane members has an upper portion and a lower portion that are vertically adjustable relative to one another.

* * * * *